United States Patent [19]

Suggitt

[11] Patent Number: 4,465,496

[45] Date of Patent: Aug. 14, 1984

[54] REMOVAL OF SOUR WATER FROM COAL GASIFICATION SLAG

[75] Inventor: Robert M. Suggitt, Wappingers Falls, N.Y.

[73] Assignee: Texaco Development Corporation, White Plains, N.Y.

[21] Appl. No.: 456,948

[22] Filed: Jan. 10, 1983

[51] Int. Cl.[3] ..... C10J 3/46

[52] U.S. Cl. ..... 48/197 R; 48/DIG. 2; 48/69; 48/206; 48/210

[58] Field of Search ..... 48/69, DIG. 2, 206, 48/210, 197 R, 202

[56] References Cited

U.S. PATENT DOCUMENTS

| | | | |
|---|---|---|---|
| 1,864,009 | 6/1932 | Allen | 48/69 |
| 3,607,157 | 9/1971 | Schlinger et al. | 48/206 |
| 3,884,649 | 10/1975 | Matthews | 48/202 |
| 3,971,638 | 7/1976 | Matthews | 48/202 |
| 4,170,550 | 10/1979 | Kamody | 423/225 |
| 4,381,924 | 5/1983 | Schmidt et al. | 48/197 R |

*Primary Examiner*—Peter F. Kratz
*Assistant Examiner*—Joye L. Woodard
*Attorney, Agent, or Firm*—Robert A. Kulason; James F. Young; James J. O'Loughlin

[57] ABSTRACT

A process for the removal of slag and other residual solid material from a coal gasification process as a suspension in water free from noxious gases normally associated therewith wherein water is drawn off from the quench section of a coal gasifier with the slag into lock hopper and is displaced by introducing cold fresh water into the lower portion of the lock hopper displacing the sour water from an exit in the upper portion of the lock hopper back into the quench section of the coal gasification system. In an alternate embodiment, noxious gases are stripped from the quench water in the lock hopper with a stripping gas. Solid waste and clean or decontaminated water are discharged from the system without pollution of the environment.

4 Claims, 1 Drawing Figure

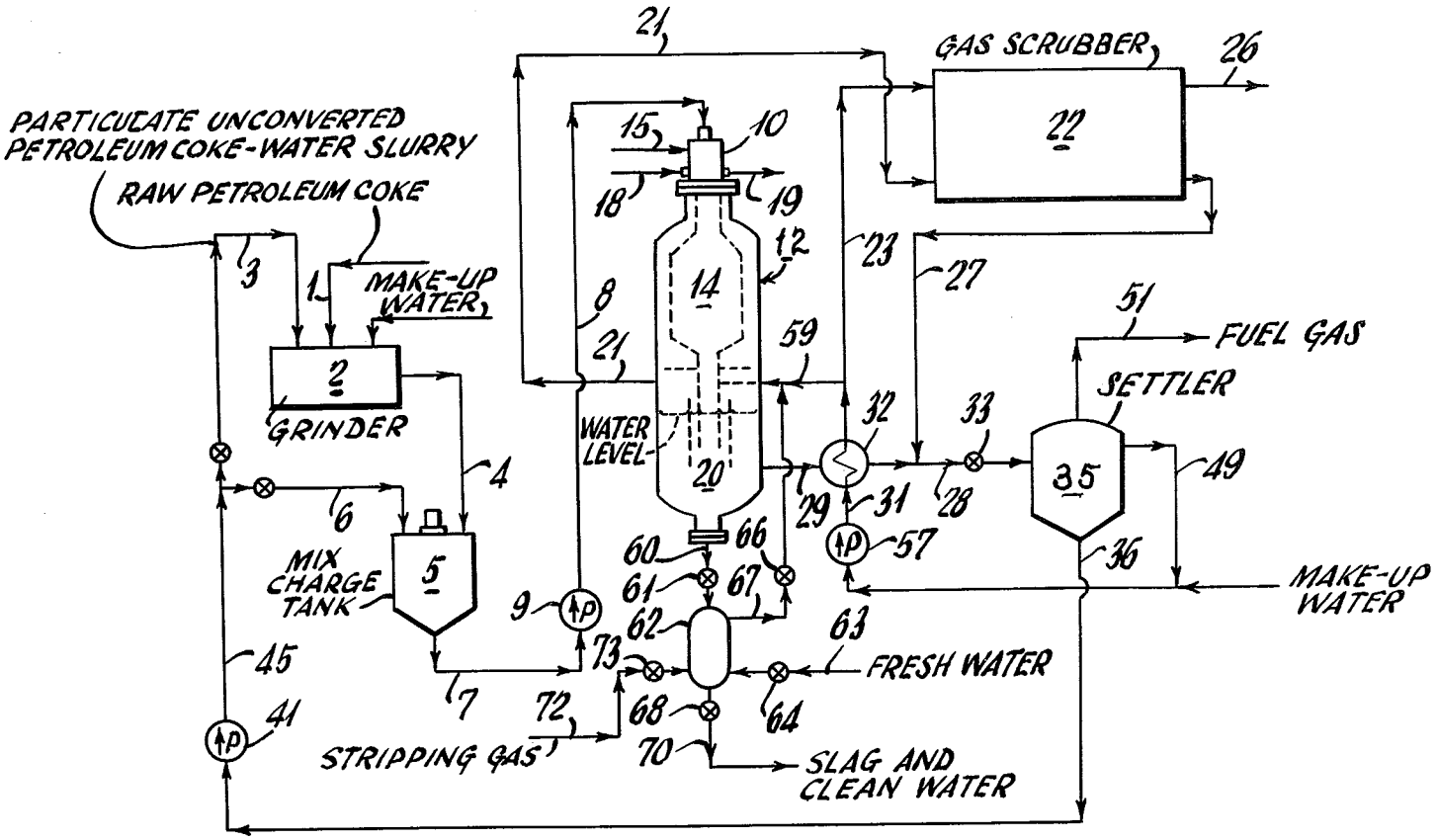
PARTICULATE UNCONVERTED PETROLEUM COKE-WATER SLURRY
RAW PETROLEUM COKE
MAKE-UP WATER
GRINDER
MIX CHARGE TANK
STRIPPING GAS
WATER LEVEL
GAS SCRUBBER
FUEL GAS
SETTLER
MAKE-UP WATER
FRESH WATER
SLAG AND CLEAN WATER

REMOVAL OF SOUR WATER FROM COAL GASIFICATION SLAG

This invention relates to an improvement in a process for the gasification of coal comprising a novel method for reducing water pollution resulting from the discharge of waste waters from a coal gasification unit. In one of its more specific aspects, this invention relates to a method for the disposal of waste waters produced by quench cooling ash, slag, and unconverted coal discharged from a coal-fired gasification unit with process water.

The method of this invention for eliminating or reducing pollution of the environment resulting from the discharge of waste waters from a coal gasification plant is particularly applicable to the Texaco Coal Gasification Process, for example, as described in U.S. Pat. No. 3,607,157. In the Texaco Coal Gasification Process, a slurry of particulate solid carbonaceous fuel, e.g. coal, or the solid residue resulting from various coal liquefaction processes, are gasified with oxygen in a flow-type reaction zone under slagging conditions. The molten slag and unconverted solid fuel, after the separation from product gas, is quench cooled and the slag solidified by direct contact with process water.

Typically, in the Texaco Coal Gasification Process, a pumpable slurry containing on the order of 50 weight percent ground solid carbonaceous fuel in water is fed into a flow-type gasification reaction zone maintained at a temperature within the range of from about 1800° F. to about 3500° F. (982° to 1927° C.) wherein the water is vaporized to steam and the solid carbonaceous fuel reacted with oxygen to produce carbon monoxide and hydrogen. Slag and ungasified solid fuel are drawn from the lower part of the gasifier into a pool of water which cools and solidifies the ungasified residue from the fuel. The quench water, also known as sour water or black water, contains contaminates in the form of dissolved salts and objectionable sulfur compounds as well as soot from the coal, all of which are objectionable from the standpoint of pollution of the environment if discharged into ponds, lakes or streams. The method of disposing of this sour water as disclosed herein eliminates the potential pollution problems.

The gasification of solid carbonaceous fuels generally is well known in the art. However, most of the prior art processes have not dealt with the problems of disposal of contaminated or sour water incidentally produced as a by-product of the gasification process. The method of this invention as disclosed herein eliminates the pollution problem in a way which is beneficial both to the environment and to the gasification process itself.

By the method of this invention, ungasified solid residue from the quench zone of a coal gasification unit, for example as disclosed in U.S. Pat. No. 3,607,157 incorporated herein by reference, is accumulated in a lock hopper in a conventional manner. Before emptying the contents of the lock hopper comprising unreacted fuel, solid residue, and sour water, the undesired constituents of sour water are eliminated from the lock hopper as disclosed hereinafter prior to discharge of water and slag from the lock hopper.

The method of this invention involves the steps of collecting ungasified residue and quench water from the coal gasification reaction system in a lock hopper, i.e. a vessel which may be isolated from the gasification reactor and its quench system and from the external environment. Such devices are well known in the prior art. After the lock hopper has been isolated from the coal gasification system and prior to discharge of its contents, the foul waters contained therein are displaced by introducing clean cold make-up water for the process into the bottom of the lock hopper displacing the sour waters from the lock hopper accumulator into the generator quench water system.

The sour waters so displaced form a part of the make-up water required for the coal gasifier wherein the water is converted to steam. Unconverted solid fuel in the sour waters so displaced is gasified and the sulfur compounds contained in the sour water are converted to hydrogen sulfide which is discharged with the product gases from the gasifier and subsequently removed from the product gas by chemical means. Soluble salts contained in the sour water are ultimately fused into the solidified slag which may be disposed of in a suitable non-polluting manner. Alternatively, the sour waters contained in the lock hopper are stripped with high pressure carbon dioxide or other gases, preferably gases produced by the gasifier from which acid reacting gases have been removed by chemical treatment. Treatment of the sour water in the lock hopper before the water is discharged from the gasifier system serves not only to displace solubilized hydrogen sulfide, hydrogen cyanide, and other solubilized compounds from the sour water, but also serves to cool the waters containing the solids prior to discharge of the slag and water mixture from the system. It is desirable that the slag-water mixture discharged from the lock hopper be at a temperature below the boiling point of water to avoid flashing part of the water to steam.

The process will be more readily understood by reference to the accompanying drawing illustrating the method of this invention as applied to a coal gasification process wherein:

The FIGURE is a general flow diagram of a preferred form of handling the gases and unconverted residues from a coal-fired gas generation plant illustrating a preferred embodiment of the present invention.

With reference to the drawing, coal is introduced through line 1 into grinder 2 wherein it is mixed with a recycled stream of water and unconverted carbonaceous residue from the gasification reactor from a source described hereinafter and subjected to grinding until about 85 to 90 weight percent of the ground coal passes a 200 mesh U.S. Bureau of Standard Screen Series Sieve. The water slurry of ground coal is discharged through line 4 into a charge tank 5 where water containing recycled unconverted coal may be added from line 6 and the concentration of coal in the slurry feed adjusted to about 50 weight percent solids.

The water-coal slurry feedstream is passed through lines 7 and 8 to a burner 10 wherein the coal-water slurry is intimately mixed with an oxygen-rich gas, preferably commercially pure oxygen (98 mole percent oxygen) introduced into the burner 10 through line 15 and discharged into reaction zone 14 of coal gasifier 12.

Reaction takes place spontaneously in reaction zone 14 at an autogenous temperature in the range of 1800° F. to 3500° F., preferably at a temperature within the range of 2200° F. to 2800° F. and at an elevated pressure in a range of atmospheric to 3000 psig, preferably in the range of 100 to 3000 psig. A product gas comprising primarily carbon monoxide and hydrogen admixed with water vapor and carbon dioxide and containing small amounts of other gases including hydrogen sulfide and possibly hydrogen cyanide from the coal is produced in reaction zone 14. Ash, which may be molten, and unconverted coal or unreacted carbon contained in the ash, typically in the amount of 8 weight percent of more of the carbon originally present in the coal feedstream, is also contained in the hot effluent gas from reaction zone 14.

The hot effluent gas from reaction zone 14 is discharged into quench water contained in quench chamber 20. Water in the quench zone effects quick cooling of the hot effluent gas to a temperature below the reaction temperature of zone 14, solidifies molten ash or slag, and removes unconverted coal, carbon, and ash from the product gas. At the same time, part of the quench water is vaporized producing steam which is useful in subsequent operations, for example, for the water gas shift reaction in which hydrogen is produced by reaction of carbon monoxide with water vapor in the presence of a suitable catalyst such as an iron oxide-chromic oxide catalyst.

Product gas is discharged from the gasifier through line 21 to a suitable scrubber 22 where it is contacted with water from line 23 for the removal of remaining solid particles from the gas stream. Gas scrubber 22 may comprise a venturi scrubber, a plate type scrubber or a packed column, all of which are well known in the art, in which product gas is intimately contacted with water to effect the removal of solid particles from the gas stream. Product gas free from solids is discharged through line 26 for further use in other processes not illustrated in the FIGURE.

The carbon-water mixture from gas scrubber 22 is passed through line 27 to line 28 where it is mixed with quench water containing carbon drawn from quench vessel 20 via line 29 and the mixture passed through pressure reducing valve 33 into settling tank 35. A heat exchanger 32 serves to heat by heat exchange with hot quench water from line 29 the relatively cool make-up and recycle water supplied through line 31 from a suitable source for quenching and scrubbing the product gas from the gas generator.

Solids, including unconverted particulate coal, settle by gravity from the water in settling tank 35 and are drawn off through line 36 as a concentrated slurry of ash, unconverted coal and soot in water. This slurry may be recycled to grinder 2 via line 36 and pump 41 to line 3. If desired, a portion of the slurry from line 36 may be diverted through line 6 into mix tank 5 to adjust the concentration of solids in the water-coal slurry feedstream charged to the gasifier.

Gases released in settler 35 may be discharged through line 48 and recovered as potential fuel gases. Clarified water from settler 35 is withdrawn through line 49 and recirculated to the quench water system through line 31 by pump 57. A portion of the water from line 31, after passing through heat exchanger 32, is supplied to quench vessel 20 through line 59 and a further portion of the water is passed through line 23 to gas scrubber 22.

Periodically slag and other heavy incombustible solids settling to the bottom of quench vessel 20 are withdrawn as a water-solids slurry through line 60 and valve 61 into lock hopper 62. Valve 61 is then closed and cold clean water from line 63 is introduced through valve 64 into the lower part of lock hopper 62. Valve 66 in line 67 is opened to establish communication between line 31 and lock hopper 62. As the cold clean water enters the lower part of lock hopper 62, hot sour water is displaced from the lock hopper and flows through line 67 and line 59 into quench vessel 20 as part of the make-up water for the quench system. After the sour water has been displaced from lock hopper 62 valves 64 and 66 are closed and valve 68 opened to permit discharge of slag and clean water from the lock hopper through line 70.

Water discharged from lock hopper 62 is clean and essentially free of the contaminants contained in the quench water. Sour water displaced from the lock hopper 62 into the quench zone 20 of gasifier 12 is thus prevented from contaminating the environment when a slurry of slag is discharged from the reactor.

In an alternate embodiment of the method of this invention, stripping gas from a suitable source, preferably carbon dioxide, or gases produced by the gasifier from which acid gases have been removed by chemical treatment, is introduced into the lower portion of lock hopper 62 through line 72 after the lock hopper has been charged with slag and sour water from the quench zone 20 and valve 61 closed. Stripping gas under pressure is introduced into the lower portion of lock hopper 62 by opening valve 73 in line 72. At the same time, valve 66 in line 67 is opened allowing gas to pass through lines 67 and 59 into the quench section of gasifier 12. The stripping gas from line 70 desorbs sour gases, i.e. sulfides, cyanides, and other noxious gases, from the water in lock hopper 62. When the desorbed gases are introduced into the gasifier, they mix with hot product gases and, after passing through the quench zone are discharged through line 21 to gas scrubber 22 as a part of the product gas stream for further purification and utilization.

I claim:

1. A method for removing solid residue from a pressurized coal gasification reactor comprising a reaction zone and a water quench zone and wherein ungasified residue from said reaction zone is cooled in said water quench zone and is removed from the water quench zone to the environment via a pressure lock zone in admixture with water from said water quench zone containing noxious gaes, the improvement which comprises eliminating noxious gases from water in said pressure lock zone by displacing said gases from said pressure lock zone into said water quench zone comprising the steps of introducing into the lowermost portion of said pressure lock zone at least one fluid medium selected from the group consisting of clean water, carbon dioxide, and coal gasification product gases from which said gases have been removed; and discharging displaced fluid comprising said noxious gases from the upper portion of said pressure lock zone into said quench zone, thereafter isolating said pressure lock zone from said quench zone, and discharging solid residue and water substantially free from noxious gases from said pressure lock zone to the environment.

2. A method as defined in claim 1 wherein said displacing fluid medium is clean water.

3. A method as defined in claim 1 wherein said displacing fluid medium is carbon dioxide.

4. A method as defined in claim 1 wherein said displacing fluid medium is product gas from said coal gasification reaction zone from which acid gases have been removed.

* * * * *